United States Patent [19]

Edwards

[11] Patent Number: 4,756,317

[45] Date of Patent: Jul. 12, 1988

[54] TOBACCO SEPARATION PRETREATMENT SYSTEM

[75] Inventor: Leon Edwards, Richmond, Va.

[73] Assignee: Hallmark Fabricators, Inc., Richmond, Va.

[21] Appl. No.: 883,589

[22] Filed: Jul. 9, 1986

Related U.S. Application Data

[62] Division of Ser. No. 504,406, Jun. 15, 1983.

[51] Int. Cl.[4] ..... A24B 15/22

[52] U.S. Cl. ..... 131/299; 131/327

[58] Field of Search ..... 131/327, 299, 290, 294, 131/295, 299, 306, 304

[56] References Cited

U.S. PATENT DOCUMENTS 3,494,724 2/1970 Gray ..... 131/299

3,828,797 8/1974 Neumann et al. ..... 131/294

OTHER PUBLICATIONS

Hirose et al.; Micro. Heat. of Multi-Lay. Cig.; J. of Micro Power 13(2); 1978; pp. 125-129.

Hirose et al.; Use of Micro. Heat. to Cont. Insects in Cig. Manag., J. of Micro Power; 10(2); 1975; pp. 181-190.

*Primary Examiner*—V. Millin

*Attorney, Agent, or Firm*—John F. C. Glenn

[57] ABSTRACT

Packed tobacco leaves are pretreated by microwave generators with control sensors preliminary to separation.

5 Claims, 1 Drawing Sheet

TOBACCO SEPARATION PRETREATMENT SYSTEM

This application is a division, of application Ser. No. 504,406, filed June 15, 1983.

BACKGROUND OF THE INVENTION

Whole leaf and strip tobacco is commonly packed in hogsheads, cases, bales, or burlap sheets, and stored for an extended period before further processing. When the time comes for further processing, it is necessary to prepare the leaves for ready separation in conventional equipment, such as an air classifier, and this is customarily done by placing one or more of the packs of leaves in a vacuum chamber and permeating them with steam, such as by means of a sharp probe to inject the steam between layers of the leaves. As a practical matter, the use of a vacuum means that this method of separation has to be operated on a batch basis and hence is limited in speed and efficiency compared to a continuous process. Moreover, some parts of the packed leaves are so much more dense and resistent to separation than others that localized parts of the pack remain unseparated. Such unseparated segments resist subsequent operations and thus cause difficulties in subsequent stages of operation.

SUMMARY OF THE INVENTION

The present invention provides a more effective and efficient apparatus and process for separating packed tobacco leaves, by replacing the conventional vacuum chamber and steam injectors with a series of microwave generators operating on a succession of bales and other forms of packs of the leaves travelling on a conveyor past microwave generator stations. One set of sensors, which may be photo-electric cells, are positioned to detect the presence of tobacco on the conveyor adjacent each microwave generator position, with connections to turn down or deactivate a microwave generator when there is no tobacco on the conveyor near that generator. A second set of sensors, which may be responsive to infrared radiation, are arranged adjacent at least the final series of microwave generators, with connections to raise the power output of each of these microwave generators when the tobacco on the conveyor adjacent that generator is below a predetermined temperature (such as 140° F.), and to turn down the power output of that microwave generator if the temperature of the tobacco on the conveyor adjacent that generator is above a predetermined limit (such as 165° F.). The particular upper and lower temperature limits which the heat sensors are set is selected with a view to avoid raising the tobacco to temperature which would cause it to puff or otherwise injure it, but to raise it to a sufficiently high temperature to put the tobacco in a condition where the leaves readily separate.

Tobacco leaves or parts of leaves treated in accordance with the invention become limp and readily separable. This effect extends even to the densor portions of the packed leaves, which would otherwise resist separation, and applies to all customary sizes of packs of tobacco leaves, from the small bales in which Turkish tobacco, for example, is usually packed, to the much larger tersabales and hogsheads of U.S. tobacco. However, in order to reduce the expense of buying particularly large microwave generating units, it may be desirable to pull apart the largest units into a pair of smaller pieces before putting them through the microwave generator treatment.

BRIEF DESCRIPTION OF THE DRAWING

The accompanying drawing schematically illustrates a presently preferred form of apparatus for practicing the invention, as follows.

DETAILED DESCRIPTION OF THE PRESENT PREFERRED EMBODIMENT

Figure 2:
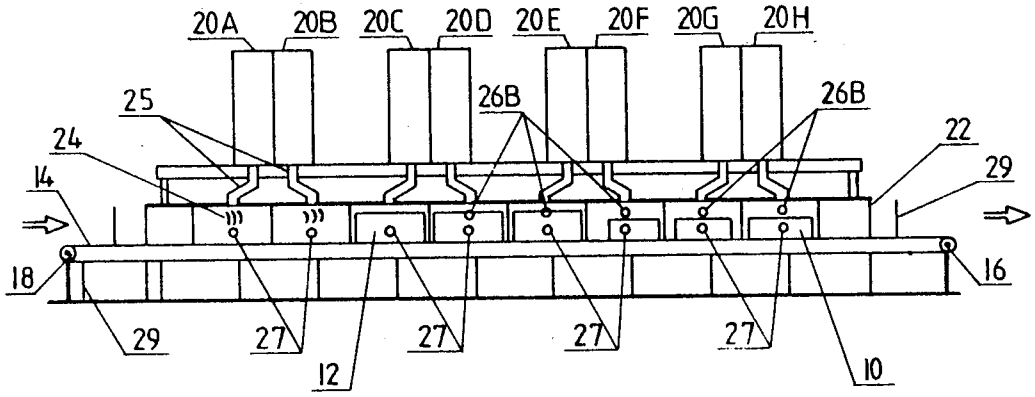
FIG. 2 shows a section on the line II—II in FIG. 1.
Figure 1:
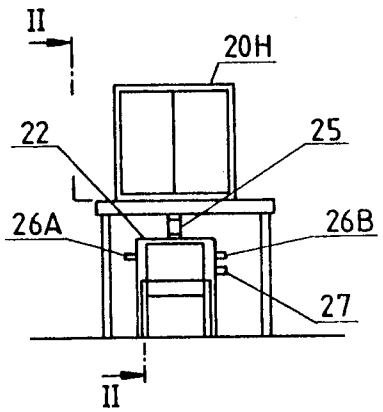
FIG. 1 is an end view of the apparatus.

Referring now more particularly to the accompanying drawing, there is shown a series of small bales 10 of tobacco leaf followed by a series of larger bales 12 of tobacco leaf, all on the upper flight of a conveyor belt 14 moving to the right as seen in the drawing. The belt 14 is of flexible material capable of reflecting microwaves, such as polished stainless steel, and is trained around a drive roller 16 and idler roller 18.

A series of microwave generators 20*a–h* are mounted along the top of a treating chamber 22, and are arranged to project microwaves 24 through wave guide outlets 25 at the top of the chamber toward the bales passing beneath them. A series of pairs of infrared sensors 26*a* and *b* are mounted in chamber 22, the sensors 26*a* being positioned on one side and the sensors 26*b* being positioned on the opposite side of the bales passing through the chamber. One pair of the infrared sensors 26*a* and *b* is positioned beneath the final generator 20*h*, and the other pairs are positioned respectively beneath the preceding microwave generators 20*d–g*. Each of these infrared sensors is connected to turn down the power of the microwave generator above it to a low enough level to avoid significant over heating of the bale opposite the sensor (rather than turning the generator entirely off, in order to extend the life of the generator), if the sensed temperature of the opposite bale is above a predetermined level such that further heating of the bale might be harmful to it. Such an upper level would be, for example, at about 150° F. On the other hand, if the sensed temperature of the bale is below a lower predetermined level, such that the tobacco would not be given enough microwave energy to accomplish the desired condition of ready separation, the sensor would turn up the power of the microwave generator above it, if the generator is not already at that level of power output. Such lower predetermined limit would usually be set at about 140° F. Between these levels there is enough melting of the resins in all the leaves to achieve the desired effect of achieving readiness for subsequent separation.

Beneath each of the microwave genrators 20*a–h* there is also provided a photoelectric cell sensor 27 which is connected to largely turn down if not entirely deactivate the microwave generator above it whenever the sensor 27 senses no pack of tobacco on the conveyor 14 beneath the adjacent microwave generator. The photoelectric sensors 27 are arranged to override any contrary signal from the infrared sensors.

It is preferable to send bales through having height variations of no more than about 1½ inches. If more than one size of bale is to go through the apparatus, outside of this limit of variation, it is preferable to send the series of bales within the size limit variation through together, and then to shift to a similarly uniform series of bales of a different average height, in order to avoid undesirable fluctuations of action of the microwave generator on the bales.

A series of rectangular panels 29 are mounted to travel with belt 14 and to project upwardly from the upper flight of the belt while passing through chamber 22. The tobacco bales are disposed on the belt between the panels. The top and side walls of chamber 22 closely fit against the panels 22 passing through them, the spacing between panels 29 corresponds to the substantially equal spacing between the wave guide outlets 25 into the top of chamber 22, and the length of chamber 22 from each of its entrance and exit ends to the outlet 25 nearest to that end is greater than the length of the longest spacing between any pair of adjacent panels 25. In this way, since the materials of panels 22 and the walls of chamber 22 are selected to resist penetration by microwaves, the escape of microwaves from the chamber is prevented.

The microwave generators have enough power to penetrate entirely through the largest unit to be treated in the apparatus, with some reflectance back of a minority of the incoming waves whose energy has not been absorbed on the way to the top surface of the conveyor belt 14. For example, the chamber 22 may have an effective internal length of about 37.5 feet (for example, a Model #CCO 160 of Cobra Electronics, Inc.), with six to eight magnetron microwave generators each of 50 KW output (for example, I.E. RCA Model C-94600 E). The rate of travel through this apparatus may be set at eight feet per minute to produce a dwell time for each bale in the chamber of a little less than five minutes, and a treatment rate of 15,000 pounds per hour on a belt three feet wide.

While methods and apparatus for practicing the invention have been illustrated and described, it will be understood that the invention is not limited thereto, but rather by the scope of the following claims.

I claim:

1. Apparatus for preparing packs of tobacco leaves or parts of tobacco leaves for ready separation, comprising a series of microwave generators capable of generating microwaves entirely through each pack, a conveyor for conveying the packs past the generators, said conveyor having a supporting surface capable of reflecting microwaves, and a series of infrared sensors respectively mounted adjacent at least the last few of the generators, each of said sensors being set to determine whether a pack on the conveyor adjacent the generator which is adjacent to the sensor is within a predetermined range of temperature of about 140° to 150° F., to turn down the microwave output of the adjacent generator if the sensed temperature of the pack is above said range, and to turn up the generator power if the sensed temperature of the pack is below said range.

2. Apparatus according to claim 1, in which the generators are magnetron microwave generator units each having an output rating of at least 50 KW.

3. A process for preparing packs of tobacco leaves or parts of tobacco leaves for ready separation, comprising the steps of continually moving said packs on a travelling conveyor surface past a series of treating positions, at least at several of said positions passing microwaves into any of the packs passing across that position with such intensity that at least some of the microwaves go through the pack and are reflected back by the surface, sensing the temperature of the packs passing across at least the final series of said positions, and regulating the projection of microwaves into the packs in response to said temperature sensing to cause each pack to reach a temperature in the range of about 140° to 150° F. before it leaves the final position.

4. The process of claim 3, in which the tobacco leaves in the treated pack have become limp and readily separable by the time they leave the last position.

5. Apparatus for reducing the force with which the constituents of packs of compacted tobacco leaves and/or parts of tobacco leaves adhere to each other, comprising a source of microwaves, and means for supporting packs in the range of microwaves which issue from said source, wherein said source comprises at least one adjustable microwave generator and the packs on said supporting means are heated as a result of absorption of microwave energy, and further comprising means for monitoring the temperature of heated packs and for adjusting said microwave generator when the monitored temperature is outside of a predetermined range.

* * * * *